United States Patent [19]

Anderson et al.

[11] 3,981,340

[45] Sept. 21, 1976

[54] COVER

[75] Inventors: Richard W. Anderson, Reading; James L. Pettee, Winchester, both of Mass.

[73] Assignee: GTE Sylvania Incorporated, Stamford, Conn.

[22] Filed: Nov. 28, 1975

[21] Appl. No.: 636,153

[52] U.S. Cl. ..... 150/52 R

[51] Int. Cl.[2] ..... B65D 65/08

[58] Field of Search ..... 150/52 R

[56] References Cited

UNITED STATES PATENTS

| | | | |
|---|---|---|---|
| 3,490,469 | 1/1970 | Dubinsky | 150/52 R X |
| 3,850,141 | 11/1974 | Schmitt | 150/52 R X |

*Primary Examiner*—Donald F. Norton
*Attorney, Agent, or Firm*—Peter Xiarhos; Elmer J. Nealon; Norman J. O'Malley

[57] ABSTRACT

A washable, stretchable, flexible, vinyl fabric cover for enclosing an adjustable arm assembly as used in a hospital or nursing home for supporting a television receiver for viewing by a patient. The adjustable arm assembly with which the fabric cover may be used includes forward and rearward pairs of elongated arms pivotally connected at adjacent ends thereof to a central pivot plate arrangement and at opposite ends thereof to front and rear pivot plate arrangements, respectively. The fabric cover of the invention includes first and second generally-flat, generally-rectangular, elongated flexible cover sections and a flat connecting sheet joining corresponding first ends of the first and second cover sections, the opposite ends of the cover sections being cup-like in configuration. The flat connecting sheet joining the first ends of the first and second cover sections has a central section of the same material as the cover sections and first and second end sections of a stretchable material attached to the central section and to the first ends of the first and second cover sections, respectively. The first and second cover sections further include slide fasteners, in the form of zippers, along the edges of the sections. The first and second cover sections are made initially to generally respectively overlie the forward and rearward pairs of arms, which are preferably in horizontal positions at this time, and the cup-like end portion of the second section is arranged to cup around the rear pivot plate arrangement. The first cover section is then pulled in a direction away from the second cover section until the cup-like end portion of the first cover section is able to tightly grip around the front pivot plate arrangement. The flat connecting sheet joining the first and second cover sections generally overlies the central pivot plate arrangement at this time. The edges of the first and second cover sections of the fabric cover are joined together to enclose the arm assembly by use of the zippers provided at these edges.

11 Claims, 9 Drawing Figures

COVER

BACKGROUND OF THE INVENTION

The present invention relates to a cover and, more particularly, to a washable, stretchable, flexible, vinyl fabric cover for enclosing an adjustable arm assembly as used in a hospital or nursing home for supporting a television receiver for viewing by a patient.

In a co-pending patent application of Gordon B. Stanley, Ser. No. 562,268, now abandoned, assigned to the same there is described in detail an adjustable arm assembly which is used to support a television receiver for viewing by a viewer such as a patient in a hospital or nursing home. As described in detail in the aforementioned patent application, the adjustable arm assembly is attached via a mounting bracket to a vertical support structure such as a wall and includes a forward pair of elongated arms and a rearward pair of elongated arms. Each of the pairs of arms includes an upper arm and a lower arm. The forward and rearward pairs of arms are pivotally connected at adjacent ends thereof to a central pivot plate arrangement by which the forward and rearward pairs of arms are able to move with respect to each other. The other ends of the forward pair of arms are pivotally connected to a front pivot plate arrangement to which a television receiver is coupled by means of an adjustable swivel attachment, and the other ends of the rearward pair of arms are pivotally attached to a rear pivot plate arrangement to which a coupling member is fixedly attached for interconnecting the arm assembly with a mounting bracket. The mounting bracket in turn is attached to the vertical supporting structure at a predetermined height from the level of the floor.

A television receiver supported by the arm assembly is maintained in a positive, drift-free, stable location at any one of several possible heights or distances from the mounting bracket by means of a plurality of pairs of load-compensated helical springs variously connected to the forward and rearward pairs of arms and to the front, central and rear pivot plate arrangements. The arm assembly is capable of movement within a large number of possible planes and of subtending an angle of at least 135° in moving between its uppermost position and its lowermost position.

While the abovedescribed adjustable arm assembly has simple and esthetically pleasing lines, by virtue of its simple, uncluttered design, it has been found desirable in some hospital and nursing home installations to provide a cover for such an arm assembly so that the arm assembly will blend with existing hospital decor. In addition, such a cover has been found desirable to prevent the accumulation of dust or other foreign matter in the various parts of the arm assembly, particularly the coils of the springs, thereby reducing the amount of cleaning maintenance required by the arm assembly. One form of cover which has been used successfully to enclose an arm assembly as described hereinabove is described in detail in U.S. Pat. No. 3,916,967, in the names of Neil K. Carlisle and James L. Pettee and assigned to the same assignee as the present application. The cover as described in the above patent includes a pair of generally-flat, generally-rectangular, flexible elongated sections of a preferably vinyl-cloth material and a flat sheet of a material such as stretch fabric joining corresponding first end portions of the elongated sections, the opposite end portions of the elongated sections being cup-like in configuration. The elongated sections further include slide fasteners, in the form of zippers, at the side edges thereof for use in completely enclosing the cover around the arm assembly. The arm assembly is enclosed by the cover as described hereinabove by positioning the elongated sections of the cover along the arms of the arm assembly and positioning the cup-like end portions of the sections with respect to the front and rear pivot plate arrangements to cup around and tightly grip the ends of these pivot plate arrangements. The latter operations are facilitated by the fact that the sheet of stretch material joining the elongated sections of the cover can be readily stretched by pulling the elongated sections in opposite directions from each other. Once the elongated sections of the cover have been made to generally surround the arms and pivot plate arrangements of the arm assembly, the edges of the sections are drawn together by use of the slide fasteners at these edges. The arm assembly may then be placed in any one of several possible operating positions with the cover accommodating each operating position of the arm assembly by virtue of the stretching capabilities of the sheet of stretch material.

While the cover as described hereinabove has been used successfully as mentioned hereinabove, the repeated and prolonged use of the arm assembly and the consequential repeated stretching of the sheet of stretch material has the effect of causing the sheet of stretch material to repeatedly rub against the central pivot plate arrangement and, in time, to become frayed. Further, is certain operating positions of the arm assembly, particularly those in which the arms of the arm assembly form small acute angles with respect to each other, it is possible for small portions of the sheet of stretch material, which overlies the central pivot plate arrangement, to become exposed and visible to a user, thereby detracting from the overall appearance of the cover.

BRIEF SUMMARY OF THE INVENTION

In accordance with the present invention a cover is provided which represents an improvement over the cover as described hereinabove and in U.S. Pat. No. 3,916,967. The improved cover in accordance with the present invention includes a first, generally-rectangular, generally-flat, flexible elongated cover section of material, and a second, generally-rectangular, generally-flat, flexible, elongated cover section of material. Each of the first and second cover sections of material has a first end portion and a second, opposed end portion having a cup-like configuration. A connecting sheet interconnects the first end portions of the first and second cover sections and includes a generally-flat, flexible, non-stretchable central section of material and first and second end sections of stretchable material connected to the central section and to the first end portions of the first and second cover sections, respectively.

The cover of the invention further includes a first means disposed at the edges of the first cover section generally parallel to the length of the first cover section, and a second means disposed at the edges of the second section parallel to the length of the second cover section. The first and second means are employed in accordance with the invention to respectively join the edges of the first and second cover sections together.

The improved cover as briefly described above is particularly useful in covering an assembly such as an arm assembly including first and second elongated arms and a plurality of pivot plates variously connected with the ends of the first and second arms. In this case, each of the first and second cover sections of the cover is used to enclose a corresponding one of the arms. As will be described in detail hereinafter, the first and second cover sections are movable with respect to each other, by virtue of the stretching capabilities of the first and second end sections of the connecting sheet, and the cup-like end portions of the cover sections are made to embrace particular ones of the pivot plates connected with the ends of the arms.

BRIEF DESCRIPTION OF THE DRAWING

Various objects, features and advantages of a cover in accordance with the present invention will be apparent from the following detailed discussion taken in conjunction with the accompanying drawing in which.

DETAILED DESCRIPTION OF THE INVENTION

Figure 1:
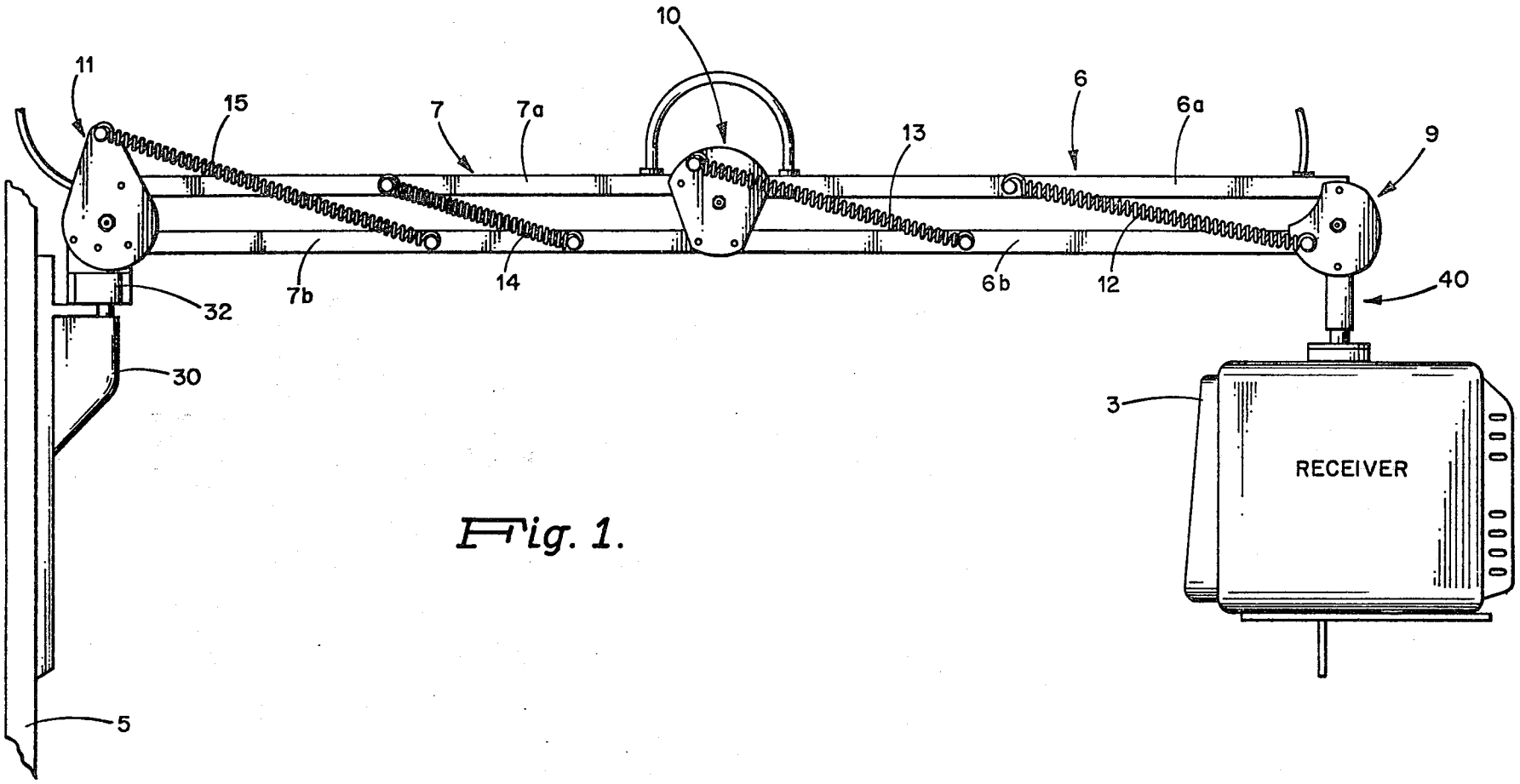
FIGS. 1–3 illustrate three operating positions of an adjustable arm assembly with which a fabric cover in accordance with the invention may be used.
Figure 2:
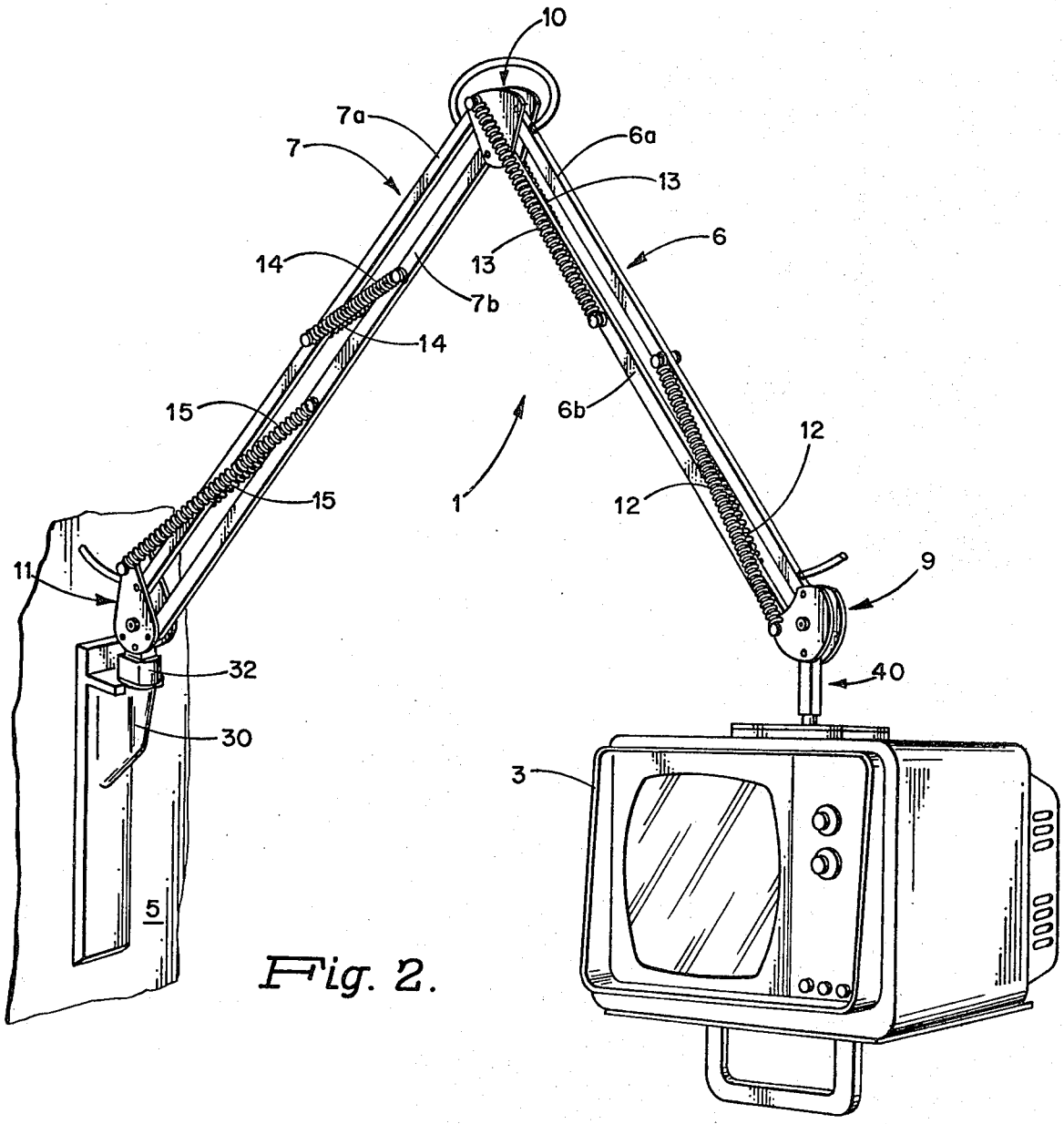
Figure 3:
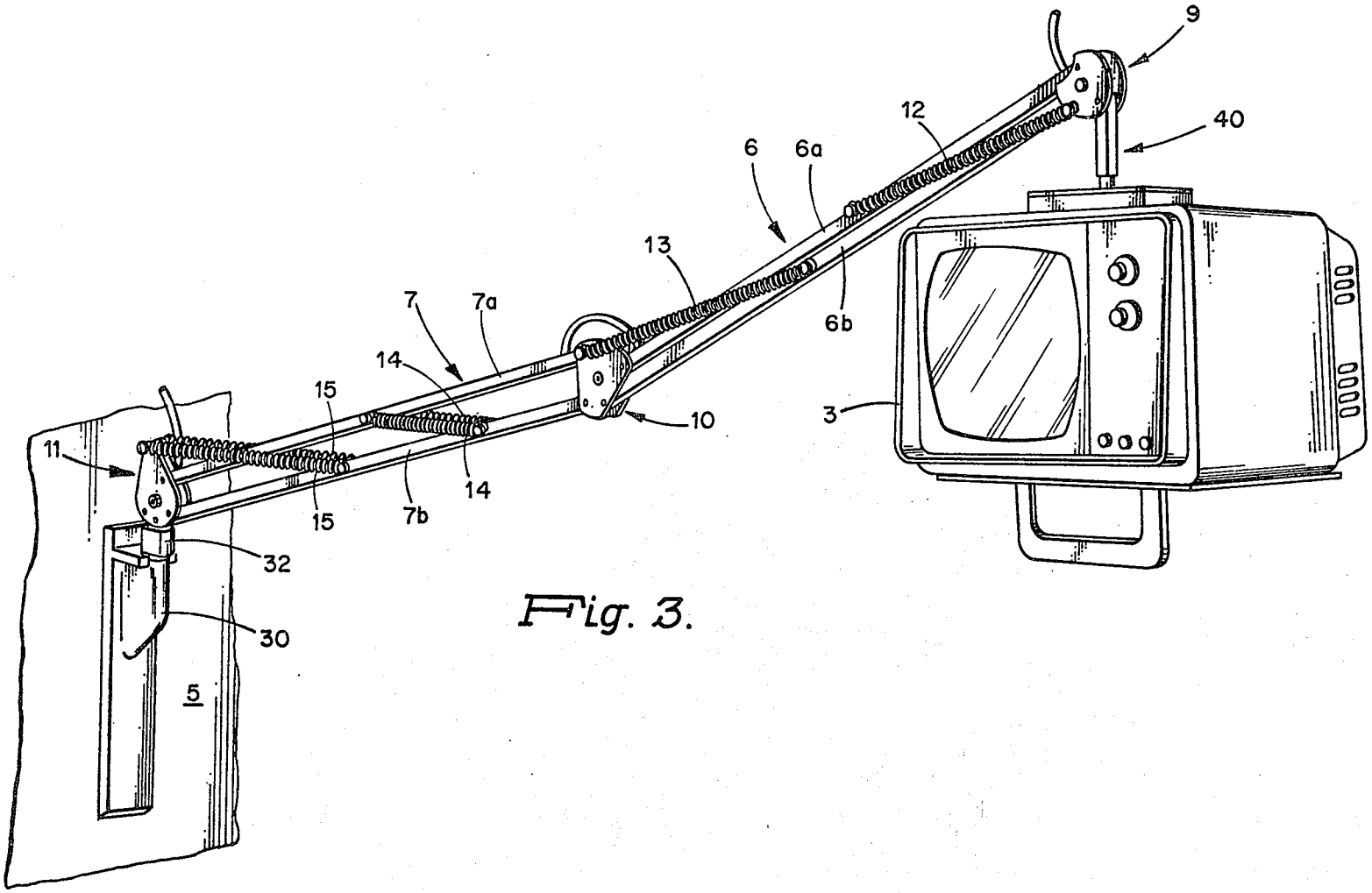

Referring now to FIGS. 1–3, there is shown an adjustable arm assembly 1 with which a fabric cover 50 (FIGS. 4–6) in accordance with the present invention may be used. As shown in FIGS. 1–3, the adjustable arm assembly 1 is arranged to support a television receiver 3 for purposes of viewing by a viewer (e.g., a patient in a hospital or nursing home), and is mounted for use to a vertical support structure such as a flat wall 5. The arm assembly 1 and the television receiver 3 are generally positioned in a typical hospital or nursing home installation so as to be readily and easily used by a patient who is in a bed or seated in a bedside chair. The arm assembly 1 generally includes a forward pair of elongated parallel arms 6, a rearward pair of elongated parallel arms 7, front, central and rear pivot plate arrangements 9, 10, and 11, respectively, and four pairs of helical springs 12–15. The forward pair of arms 6 includes an upper arm **6*a* and a lower arm 6*b* and, similarly, the rearward pair of arms 7 includes an upper arm 7*a* and a lower arm 7*b*. The arms 6*a*, 6*b*, 7*a* and 7*b* are typically of the same length, for example, 25.5 inches, and are typically formed from hollow, tubular stock, for example, of steel, having a typically rectangular cross section. As shown in FIGS. 1–3, the arms 6*a* and 6*b* of the forward pair of arms 6 are adjustably connected between the front and central pivot plate arrangements 9 and 10, respectively, and, similarly, the arms 7*a* and 7*b* of the rearward pair of arms 7 are adjustably connected between the central and rear pivot plate arrangements 10 and 11**, respectively. Any suitable fastening members, such as pivot pins and the like, may be used for the above purpose.

The aforementioned pairs of helical springs 12, 13, 14 and 15 are variously connected between the arms **6*a*, 6*b*, 7*a* and 7*b* and the pivot plate arrangements 9, 10 and 11. Specifically, the pair of springs 12 is connected from opposite sides of the arm 6*a* to corresponding sides of the arm 6*b* (via the front pivot plate arrangement 9); the pair of springs 13 is connected from opposite sides of the arm 6*b* to corresponding, opposite sides of the central pivot plate arrangement 10; the pair of springs 14 is connected from opposite sides of the arm 7*a* to corresponding opposite sides of the arm 7*b*; and the pair of springs 15 is connected from opposite sides of the arm 7*b* to corresponding opposite sides of the rear pivot plate arrangement 11. The above-described pairs of helical springs 12, 13, 14 and 15, typically of steel, are selected to have physical characteristics and are positioned with respect to the arms 6*a*, 6*b*, 7*a* and 7*b* and the pivot plate arrangements 9, 10 and 11 so as to enable the arm assembly 1 to support the television receiver 3 so that the receiver 3 may be easily and readily located for viewing in any one of a very large number of possible positions from the wall 5**, both high and low and near and far, and in a positive, stable, drift-free fashion.

The arm assembly 1 as described hereinabove is attached to a vertical support structure, such as the wall 5, by means of a wall mounting bracket 30 and a coupling member 32. The wall mounting bracket 30, of a standard configuration, is secured to the wall 5 and includes a generally cylindrical cavity therein within which a cylindrical mating part of the coupling member 32 is received and within which the coupling member 32 is able to rotate to provide horizontal movement for the arm assembly 1. The coupling member 32 is fixedly attached at an upper part thereof to the rear pivot plate arrangement 11. A television receiver to be used with the arm assembly 1, such as the television receiver 3 shown in FIGS. 1–3, is attached to the arm assembly 1, specifically, to the front pivot plate arrangement 9, by means of an adjustable swivel attachment 40.

Figure 4:
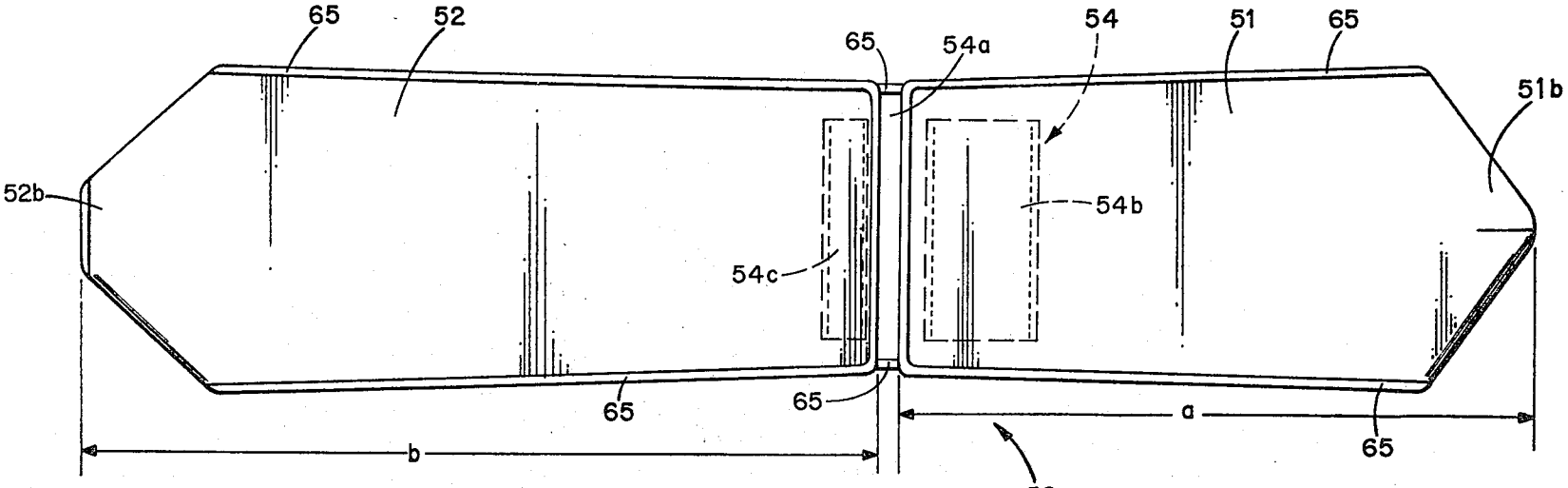
FIGS. 4 and 5 are top and bottom views of the fabric cover in accordance with the invention.
Figure 5:
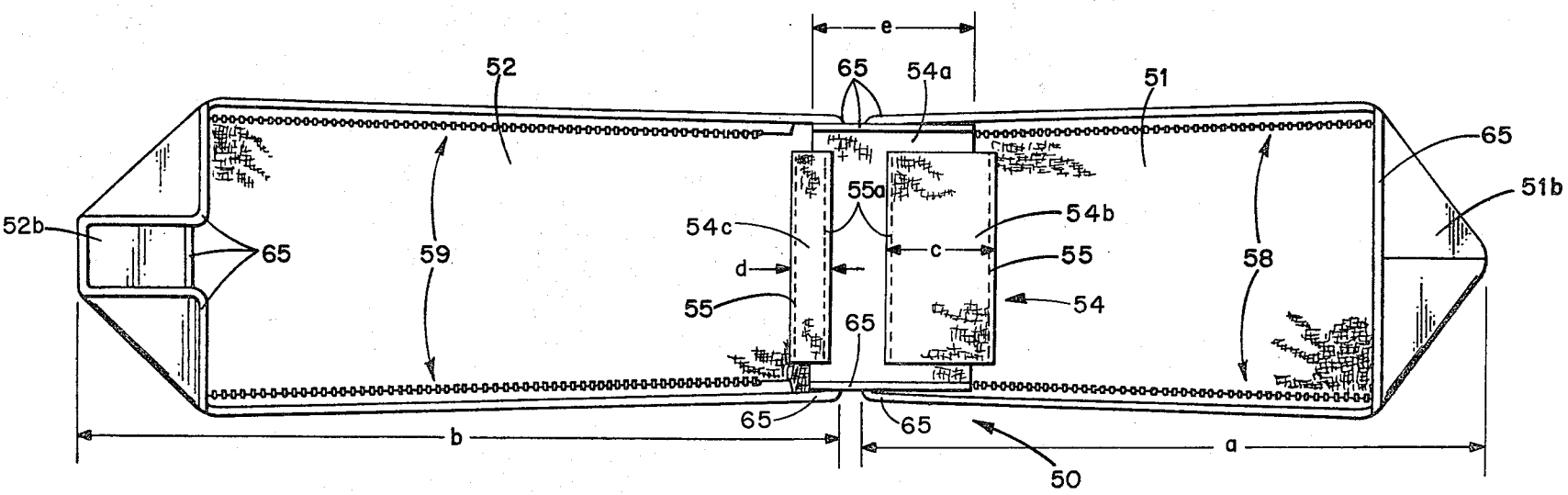
Figure 6:
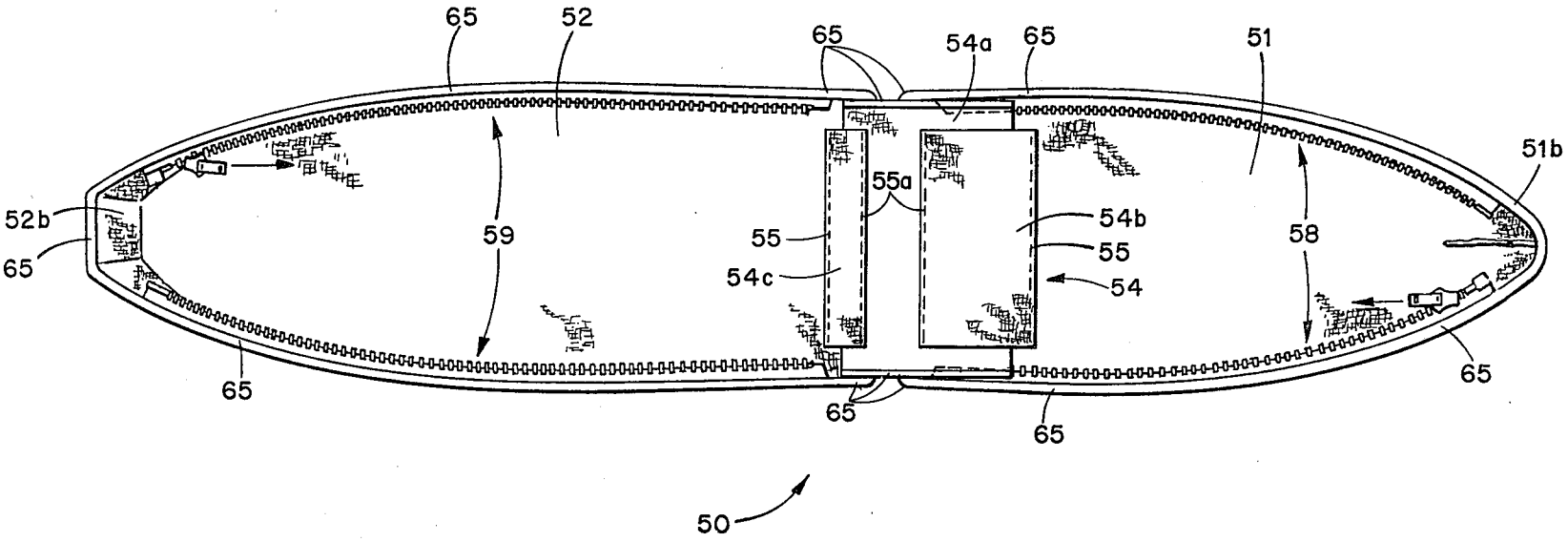
FIG. 6 is a view of the cover of FIGS. 4 and 5, illustrating certain internal details of the cover.

The fabric cover 50 of the invention which may be used with the abovedescribed adjustable arm assembly 1 is shown in detail in FIGS. 4–6. As shown in these figures, the fabric cover 50 includes a first generally-flat, generally-rectangular, flexible, elongated cover section 51 and a second generally-flat, generally-rectangular, flexible, elongated cover section 52. The first cover section 51 of the cover 50 is used primarily to enclose the arms **6*a* and 6*b* of the forward pair of arms 6 of the arm assembly 1** and has a length *a* slightly greater than the lengths of the arms **6*a* and 6*b*, for example, 27.5 inches. Similarly, the second cover section 52 of the cover 50 is used primarily to enclose the arms 7*a* and 7*b* of the rearward pair of arms 7 of the arm assembly 1** and has a length *b* slightly greater than the lengths of the arms **7*a* and 7*b*, for example, 26 inches. Suitable minimum and maximum widths for the cover sections 51 and 52** are 8 inches and 9 inches, respectively.

The cover sections 51 and 52 of the cover 50 are joined, or interconnected, at adjacent ends thereof by means of a flat connecting sheet 54, the connecting sheet 54 being typically secured to the sections 51 and 52 by means of stitching, as shown at 55 in FIGS. 5 and 6. As best shown in FIGS. 5 and 6, the connecting sheet 54 includes a central section **54*a*, for example, of a non-stretchable material having superior wear characteristics, and first and second end sections 54*b* and 54*c* of a stretch material connected to the central section 54*a*, as by stitching 55*a*, and to the cover sections 51 and 52. The width of the end section 54*b***, indicated at *c* in FIG. 5, is made to be greater than the width of the end portion 54*c*, indicated at *d* in FIG. 5, inasmuch as the forward pair of arms 6*a* and 6*b* with which the cover section 50 is used is normally moved much more frequently than the rearward pair of arms 7*a* and 7*b*. Typical values for the dimensions *c* and *d* are 4¾ inches and 1¼ inches, respectively. A typical value for the width of the central section 54*a* of the connecting sheet 54, shown at *e* in FIG. 5, is 7¼ inches.

The first and second cover sections 51 and 52 of the cover 50 further have zippers 58 and 59 respectively associated therewith for use in enclosing the arm assembly 1 with the cover 50. The zipper 58 and 59 are of a conventional construction and are discussed in detail in the aforementioned U.S. Pat. No. 3,916,967.

The first and second cover sections 51 and 52 further include cup-like end portions 51*b* and 52*b*, respectively, as best shown in FIGS. 5 and 6. The end portion 51*b* of the cover section 51 is adapted to grip around the end of the front pivot plate arrangement 9 of the arm assembly 1, and, for this reason, is made to have a generally round, curved contour. The end portion 52*b* of the cover section 52 is adapted to grip around the end of the rear pivot plate arrangement 11 and also around a portion of the associated coupling member 32 and, for this reason, is made to have a generally squared-off configuration. For other designs of arm assemblies, the end portions 51*b* and 52*b* may have other physical configurations.

The cover 50 as described hereinabove may be constructed from well-known, readily-available materials. By way of example, the cover sections 51 and 52 of the cover 50 and the central sections 54*a* of the connecting sheet 54 may be constructed from a non-stretchable two-layer material having an outer layer of vinyl, which is washable, and an attached inner layer of cloth. The edges of the cover sections 51 and 52 and of the central section 54*a* of the connecting sheet 54 are preferably protected by bindings as shown at 65 in FIGS. 4–6. The end sections 54*b* and 54*c* of the connecting sheet 54 may be of a stretch fabric or, alternatively, of rubber or other similar material.

Figure 7:
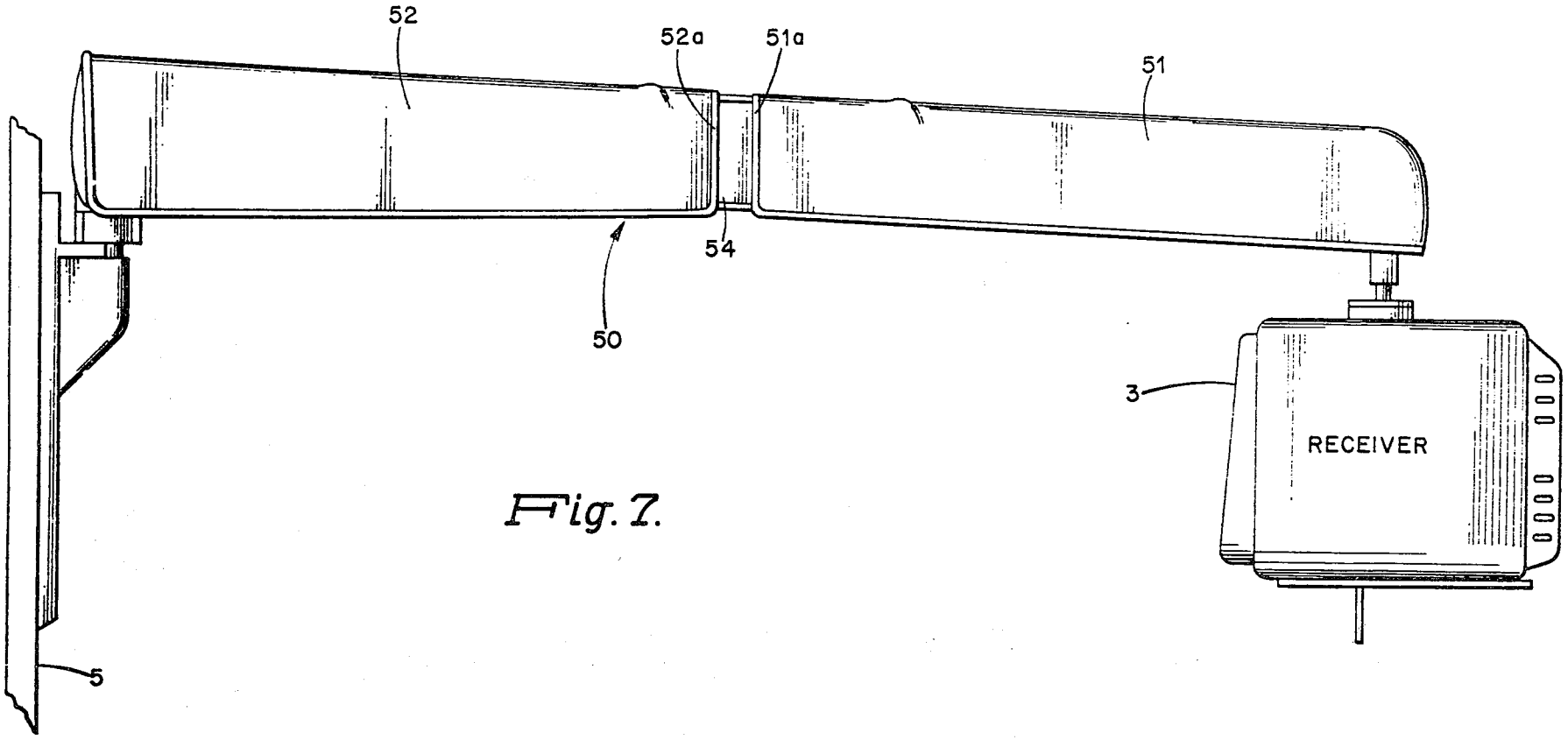
FIGS. 7–9 illustrate the manner in which the cover of the invention is used to enclose the adjustable arm assembly as shown in FIGS. 1–3.

To cover the arm assembly 1 with the cover 50 so that the pairs of arms 6 and 7 and the pivot plate arrangements 9–11 are enclosed by the cover 50, the arm assembly 1 is first preferably placed in a horizontal position with the pairs of arms 6 and 7 extending outwardly horizontally, as shown, for example, in FIG. 1. One end of the cover 50, for example, the end portion 52*b* of the cover section 52, is then made to partly enclose the rear pivot plate arrangement 11 and the associated coupling member 32 so that the end portion 52*b* cups around and grips the end of the rear pivot plate arrangement 11 and the coupling member 32. The other section 51 is then pulled in a direction toward the front pivot plate arrangement 9, the end sections 54*b* and 54*c* of the connecting sheet 54 being stretched by this pulling operation, and, when the cover section 51 has been pulled sufficiently so that the end portion 51*b* is immediately adjacent to the front pivot plate arrangement 9, the end portion 51*b* is then made to cup around and grip the end of the front pivot plate arrangement 9. At this time, the cover 50 is under tension with the compressive forces being in a direction toward the center of the arm assembly 1. The zippers 58 and 59 are then zipped up in the same direction as the compressive forces, that is, in a direction from the end portions 51*b* and 52*b* toward the center of the cover 50. FIG. 7 illustrates the arm assembly 1 as shown in FIG. 1 after it has been enclosed by the cover 50.

As can be seen from FIG. 7, in the particular position of the arm assembly 1 as shown in FIG. 7, the ends of the cover sections 51 and 52 are spaced from each other by a slight distance and the central section 54*a* of the connecting sheet 54 overlies the central pivot plate arrangement 10. The end sections 54*b* and 54*c* of the connecting sheet 54 are not visible when the arm assembly is in the position shown in FIG. 7 and, therefore, the connecting sheet 54 does not detract from the appearance of the cover 50. The other portions of the sections 51 and 52 generally overlie and enclose the pairs of arms 6 and 7 and the pivot plate arrangements 9 and 11.

Figure 8:
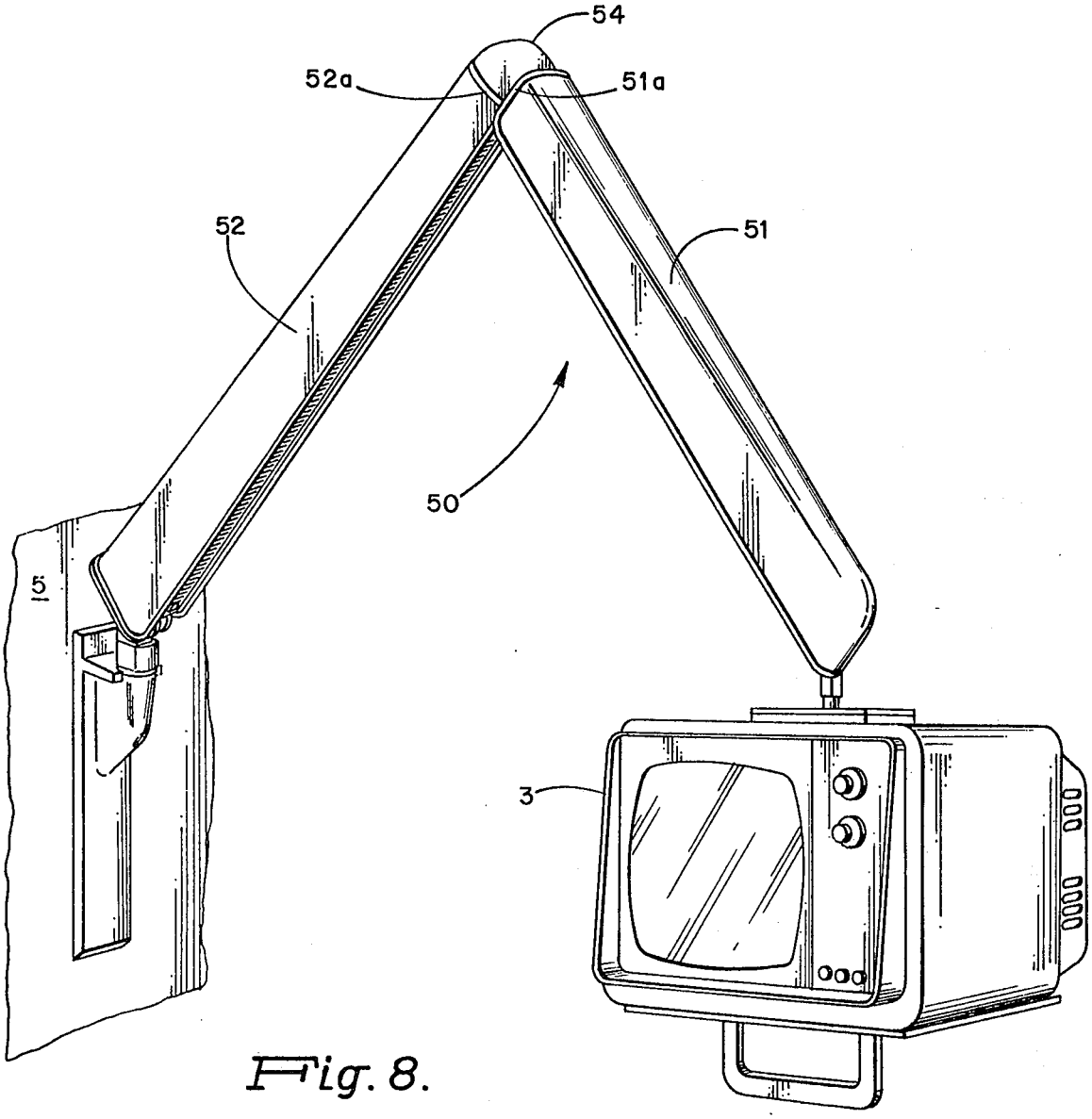

FIG. 8 illustrates the arm assembly 1 with the cover 50 thereon after the arm assembly 1 has been adjusted so that the pairs of arms 6 and 7 form an acute angle with respect to each other, in the manner shown, for example, in FIG. 2. In this particular position of the arm assembly 1, movement of the pairs of arms 6 and 7 causes the cover sections 51 and 52 of the cover 50 to be pulled in opposite directions from each other, as the end sections 54*b* and 54*c* of the sheet 54 stretch, and the central section 54*a* of the connecting sheet 54, as before, generally overlies the central pivot plate arrangement 10. The cover sections 51 and 52 in this case move with the pairs of arms 6 and 7 away from the connecting sheet 54 and do not interfere in any way with the covering function of the connecting sheet 54. It will be noted from FIG. 8 that, as before, the central section 54*a* of the connecting sheet 54 is exposed when the arm assembly 1 is in the particular position shown in FIG. 8, but since the material of the section 54*a* is the same as that of the cover sections 51 and 52, it has the same general appearance as the cover sections 51 and 52.

Figure 9:
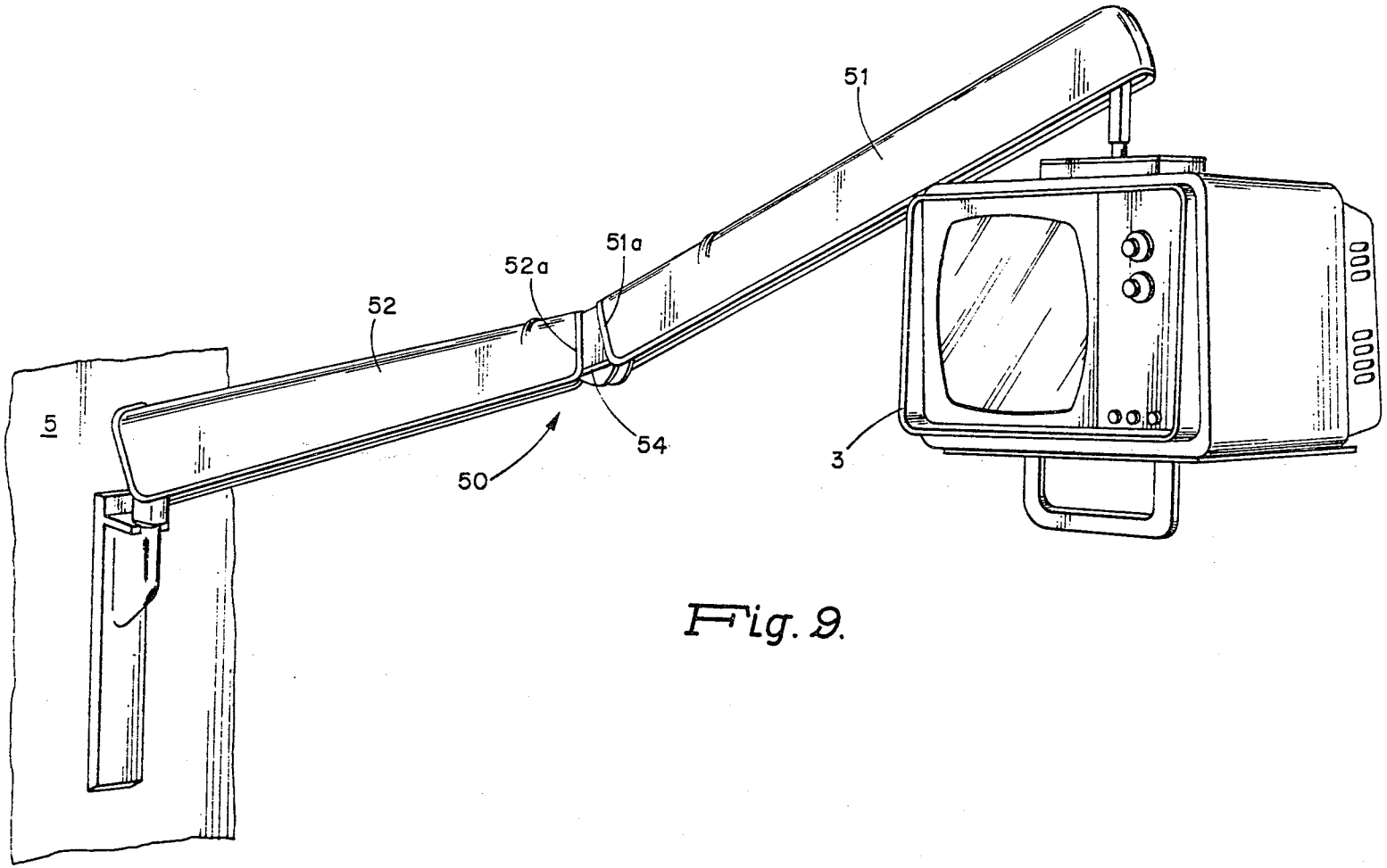

FIG. 9 illustrates the arm assembly 1 with the cover 50 thereon after the arm assembly 1 has been adjusted so that the pairs of arms 6 and 7 form an obtuse angle with respect to each other, in the manner shown, for example, in FIG. 3. In this particular position of the arm assembly 1, the movement of the pairs of arms 6 and 7 causes the cover sections 51 and 52 of the cover to move toward each other whereby only a small part of the central section 54*a* of the connecting sheet 54 is visible. The cover 50, therefore, by virtue of its sections 51 and 52 being able to move respect to each other, is capable of conforming to any particular position of the arm assembly 1. Further, even with frequent changes in the positions of the arms of the arm assembly 1, the central section 54*a* of the connecting sheet 54, by virtue of having superior wear characteristics, is able to withstand the abrading effects as it rubs against the central pivot plate arrangement of the arm assembly 1.

While there has been described what is considered to be a preferred embodiment of the invention, it will be obvious to those skilled in the art of that various changes and modifications may be made therein without departing from the invention as called for in the appended claims.

What is claimed is:

1. A cover comprising:

a first, generally-rectangular, generally-flat, flexigle, elongated cover section of material having a first end portion and a second, opposed end portion, said second end portion having a cup-like configuration;

a second, generally-rectangular, generally-flat, flexible, elongated cover section of material having a first end portion and a second, opposed end portion, said second end portion having a cup-like configuration;

a connecting sheet interconnecting the first end portions of the first and second cover sections and including a generally-flat, flexible, non-stretchable central section of material and first and second end sections of stretchable material connected to the central section and to the first end portions of the first and second cover sections, respectively;

first means disposed at the edges of the first cover section generally parallel to the length of the first cover section for joining the edges of the first cover section together; and second means disposed at the edges of the second cover section generally parallel to the length of the second cover section for joining the edges of the second cover section together.

2. A cover in accordance with claim 1 wherein:

each of the first and second means includes a slide fastener.

3. A cover in accordance with claim 2 wherein the slide fastener is a zipper.

4. A cover in accordance with claim 1 wherein:

the first and second cover sections and the central section of the connecting sheet are all of a two-layer material including a washable vinyl outer layer and a cloth fabric inner layer.

5. A cover in accordance with claim 4 wherein:

the first and second end sections of the connecting sheet are of a stretch fabric material.

6. A cover in accordance with claim 1 wherein:

the first and second end sections of the connecting sheet are of different widths.

7. A cover for an arm assembly, said arm assembly including first and second adjacent elongated arms, a first means interconnected with adjacent ends of the first and second arms, and second and third means respectively connected with the other ends of the first and second arms, said cover comprising:

a first, generally-rectangular, generally-flat, elongated cover section of material for use with the first elongated arm, said first cover section having a first end portion and a second, opposed end portion having a cup-like configuration;

a second, generally-rectangular, generally-flat, elongated cover section of material for use with the second elongated arm, said second cover section having a first end portion and a second, opposed end portion having a cup-like configuration;

a connecting sheet interconnecting the first end portions of the first and second sections and including a generally-flat, flexible, non-stretchable central section of material and first and second end sections of stretchable material connected to the central section and to the first end portions of the first and second cover sections, respectively;

one of the first and second cover sections being arranged initially with respect to its associated arm so that the cover section generally overlies the arm and the cup-like end portion thereof embraces the associated one of the second and third means at the end of the arm, whereby when the other cover section is pulled, together with the connecting sheet, in a direction away from the said one of the cover sections and the cup-like end portion of the other cover section is adjacent to the associated one of the second and third means at the end of the associated arm, the end portion may be made to embrace the associated one of the second and third means at the end of the arm, said connecting sheet overlying the first means when the cup-like end portions of the first and second cover sections embrace the second and third means;

said first and second cover sections further having joining means disposed at the edges of the sections generally parallel to the lengths thereof, said joining means being operable when the first and second cover sections overlie the first and second arms, respectively, the connecting sheet overlies the first means, and the cup-like ends of the first and second cover sections embrace the second and third means to join said edges together, thereby to enclose the first and second arms and the first, second and third means.

8. A cover in accordance with claim 7 wherein the joining means includes:

a first slide fastener disposed at the edges of the first cover section; and a second slide fastener disposed at the edges of the second cover section.

9. A cover in accordance with claim 7 wherein:

the first and second cover sections and the central section of the connecting sheet are all of a two-layer material including a washable vinyl outer layer and a cloth fabric inner layer.

10. A cover in accordance with claim 9 wherein:

first and second end sections of the connecting sheet are of a stretch fabric material.

11. A cover in accordance with claim 7 wherein:

the first and second end sections of the connecting sheet are of different widths.

* * * * *